United States Patent [19]

Pichler et al.

[11] Patent Number: 4,727,805

[45] Date of Patent: Mar. 1, 1988

[54] SHUTTLE FOR MATRIX PRINTERS

[75] Inventors: Josef Pichler, Ebreichsdorf; Karl Puchegger, Foehrenau, both of Austria

[73] Assignee: Mannesmann Tally GmbH, Vienna, Austria

[21] Appl. No.: 777,538

[22] Filed: Sep. 18, 1985

[30] Foreign Application Priority Data

Sep. 18, 1984 [EP] European Pat. Off. ..... 84111106.5

[51] Int. Cl.[4] ..... B41J 3/12

[52] U.S. Cl. ..... 101/93.04; 400/320; 400/354; 400/59

[58] Field of Search ..... 101/93.04, 93.29; 400/59, 320, 354, 354.1, 354.2, 354.3

[56] References Cited

U.S. PATENT DOCUMENTS

| | | | |
|---|---|---|---|
| 4,359,289 | 11/1982 | Barrus et al. | 101/93.04 |
| 4,402,620 | 9/1983 | Kekas et al. | 101/93.04 |
| 4,416,560 | 11/1983 | Wood et al. | 400/320 |
| 4,425,047 | 1/1984 | Narushima | 400/320 |
| 4,452,542 | 6/1984 | Akazawa | 400/354 |
| 4,502,382 | 3/1985 | Kunita et al. | 101/93.04 |

OTHER PUBLICATIONS

E. Hungarter; "Flexible Cable"; *IBM Tech. Disc. Bull.; vol. 22, No. 12, p. 5303; May 1980.*

M. A. Moser et al.; "Head-to-Platen Gap Adjuster"; IBM Tech. Disc. Bull.; vol. 25, No. 10, p. 5181; Mar. 1983.

R. K. Floyd et al.; "Automatic Paper-Thickness Adjuster for Input Printhead"; *IBM Tech. Disc. Bull.;* vol. 26, No. 2, p. 534; Jul. 1983.

*Primary Examiner*—Edgar S. Burr
*Assistant Examiner*—David A. Wiecking
*Attorney, Agent, or Firm*—Ralf H. Siegemund

[57] ABSTRACT

A matrix line printer has an L-shaped shuttle for a series of electromagnetic actuators. Wires are provided running in an arc from the printer frame to the shuttle. Peojections on the shuttle engage eccentrically mounted rollers on the frame.

9 Claims, 5 Drawing Figures

SHUTTLE FOR MATRIX PRINTERS

BACKGROUND OF THE INVENTION

The present invention relates to a matrix printer particularly a matrix line printer having a reciprocating carrier or shuttle carrying the printing elements such as hammers or styli and including electromagnets for actuating the print elements.

Matrix printers of the type to which the invention pertains are usually used as data output devices having to deal with a rather high volume of date to be outputted. In addition or alternatively, they serve in word processing equipment permitting high quality or letter quality printing, for example, for correspondence or the like. A printer of the type to which the invention pertains is, for example, disclosed in U.S. Pat. No. 3,999,644 (see also German printed patent application No. 22 24 116). In this particular printer a shuttle or carriage is provided with a relatively large number of electromagnets each moving a printing needle or stylus in the direction toward the printing platen. The rear ends of these electromagnets are provided with a requisite connection which include a flexible cable for connection to a logic circuit which in turn is selectively driven by means of a character generator. Typically the printer may be equipped with about 33 electromagnets, requiring accordingly 66 cable connections.

Aside from the number of the cable connections involved a disadvantage is the fact that the carrier for the electromagnets does move so that the connections have to be moved too. The speed as well as acceleration of the shuttle is quite high so that the electromagnets have to be firmly secured to the carrier in a durable fashion wherby in addition particular features are required to insure equidistant spacing between the needles and a very accurate transverse orientation to the printing platen as well as to the recording medium on the platen. Accordingly, the known devices deem a particular fastening structure to be required as, for example, described in particularity in German Pat. No. 24 24 629.

The device disclosed in this German patent includes a bar-shaped carrier being provided with a plurality of holding devices arranged laterally and in juxtaposed position. An electromagnet constituting a unit is fastened thereto and arranged thereon together with the printing needles and their guidance structure. Each holding structure, moreover, is included with a semicylindrical seat for receiving the electromagnet, and there is a back provided for the bearing and guidance of the printing needles. All these aspects render the bar-shaped carrier heavy and expensive. Not only is the construction as such expensive but the relative high weight requires correspondingly high moving forces. All this is effective in some fashion on other modules and components or component groups within the printer. As a consequence the electric drive mechanism and the support for the bar-shaped carrier are expensive and have to be rated higher as far as dimensions are concerned than would be necessary strictly from a funcitonal point of view.

For physical reasons one can see that it is not a good solution to increase the mass of the bar-shaped carrier carrying the electromagnets and to increase the weight of the overall carriage through a particular fastening structure. In addition, of course, there has to be considered that another drawback is the increase in weight on account of the cable connection. Moreover the life of electric conductors is limited in any event.

DESCRIPTION OF THE INVENTION

It is an object of the present invention to provide a new and improved carrier for print elements in a matrix line printer carrier which is of relatively low weight and can be manufactured in an economical fashion and meets all the requirements of reciprocating motion for the printing head in such a matrix printer.

In accordance with the preferred embodiment of the present invention it is suggested to provide a reciprocating carrier for the print element as a structural piece or bar having an L-shaped cross section and profile, the electromagnets being fastened to an upright wall of the bar and whereby the fastening means are accessible and inserted into that wall from the side facing the platen, the electromagnets are situated on the other side. The L-shaped rod or bar combines the known bar-shaped carrier per se with the holder for the electromagnets in a single piece, integral component and therewith a considerable quantity in movable weight is saved. The L-shaped profile rod, moreover, can actually be selected from traded parts and requires merely a fine finish in order to permit incorporation into a precision instrument such as a matrix printer. The position of the electromagnets can be determined and selected through uniform working of the longitudinal edges of the rod, and the bores for the electromagnets can be correspondingly determined and selected in accordance with requisite distance and direction meeting high accuracy and low tolerance requirements. Thus, the inventive carrier for printing elements can be manufactured simply, easily, accurately, and economically.

The guide and support of this carrier, particularly for purposes of permitting reciprocating motion, can be correspondingly made simple, safe, and durable. Certain guide projections are provided on the carrier parallel to the row of the print elements when in rest or in printing position and bearing against rolls which are rotatably mounted in stationary bearings in the chassis, frame, or housing of the printer. Accuracy of the guidance, or shuttle can be enhanced during assembly, facilitating any maintenance work, in that these rollers are individually adjustable.

The electrical connections for the electromagnet, of course, have to be made through suitable cable and they experience the reciprocating motion. However, these motions can be dealt with without endangering the connection in that each of the electromagnets is connected with flat conductors being insulated in a carrier material, running in a curve or bow from the movable carrier bar to stationary plug contacts. The curve of the individual conductors actually permit motion transversely to the curve, i.e. in the flat conductor's cross-section on account of the curvature which is a surprising result. The desired curving is simply attributable to a low bending resistance of the flat conductors.

The improved manner of running the conductors from the shuttle to the stationary equipment as well as overall organization, durability and long term operation, bending points ease of exchange of components etc., all can be simplified in that the flat insulated conductors are provided with a small thickness and are individually run to a common holder, so that the flat individual conductors after passing further fastenings, are combined in a single ribbon cable organized in groups with a plug for each group.

The cable connection in the immediate vicinity of the electromagnets can be installed in an economical fashion in that the individual flat insulated conductors are fastened in the immediate vicinity of the electromagnetic coil by means of holding strips or the like. These holding strips provide also for tension relief vis-a-vis solder points of the connections to the electromagnetic coil. The fastening of the holding strip themselves is affected, for example, by providing an adhesive.

Handling installation, contact with printer etc., can be facilitated further in that the flat ribbon cable are on both sides provided with flexible holders in the transition zone of the curve to a different, e.g., straight direction of extension. The basic concept of employing a flat ribbon cable for the print head, i.e. a carrier with electromagnetic magnets and print elements, may be developed further in that for additional electrical equipment, such as sensors etc., further flat conductors maybe assigned within the ribbon cable.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

DETAILED DESCRIPTION OF THE DRAWINGS

Figure 1:
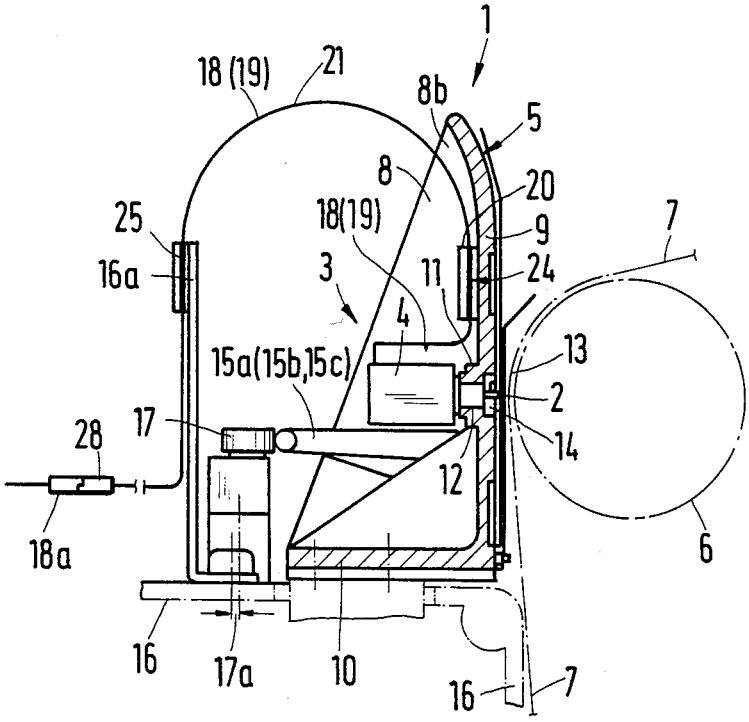
FIG. 1 is a cross-section through a carrier for print elements in a matrix printer and constructed in accordance with the preferred embodiment of the present invention for practicing the best mode thereof.
Figure 2:
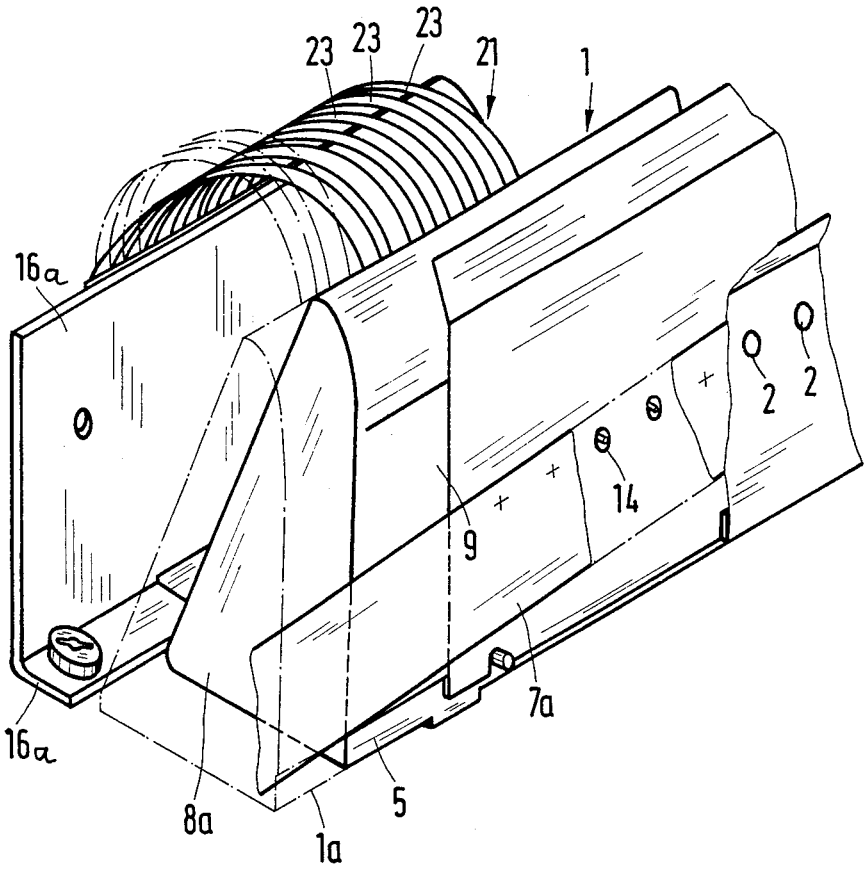
FIG. 2 is a isometric view of the carrier shown in FIG. 1, showing also the print elements from a direction in the right front part exposing outside of the L-shaped carrier bar.
Figure 3:
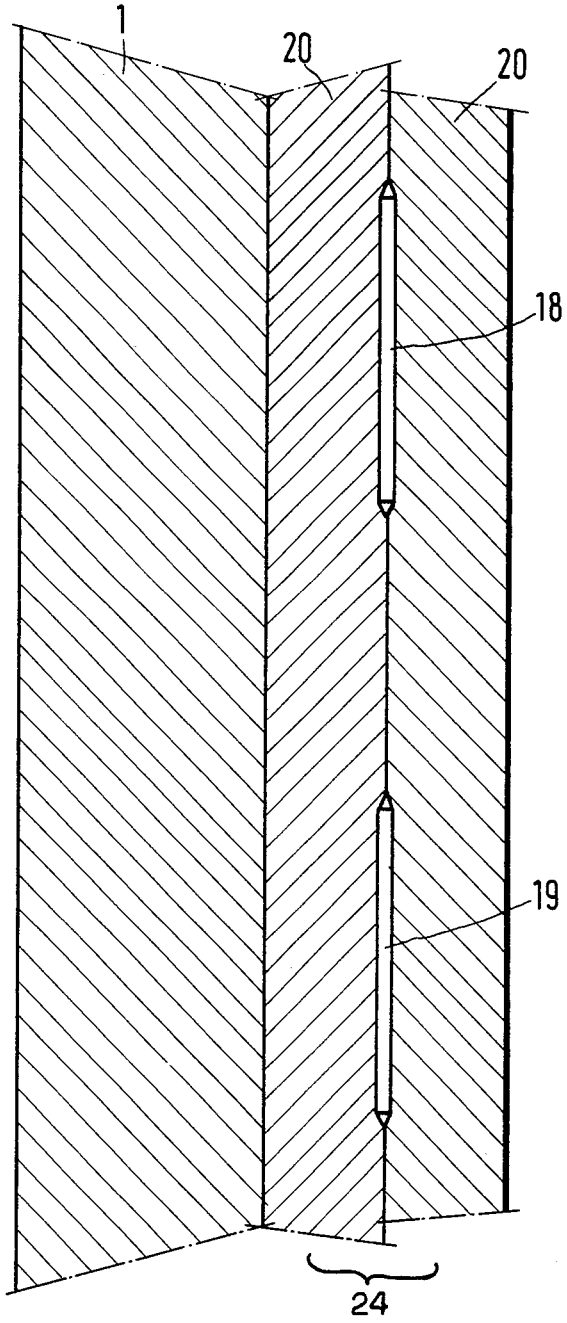
FIG. 3 is a cross-section of a very enlarged scale through a mounting strip used in the carrier shown in FIGS. 1 and 2.

The matrix printer and components thereof shown in FIGS. 1, 2, and 3 is assumed to be a matrix line printer. Conventional elements such as a motor, paper transport etc. are not shown, for reasons of simplicity but FIG. 1 shows a platen 6 and paper 7 to be printed on. A carrier 1 being the shuttle is shown carrying print elements, i.e. particularly short print needles or styli 2. Cable connections 3 for electromagnets 4 driving these elements 2 are also mounted on the carrier 1 in a manner to be described more fully below.

The reciprocating motion of the shuttle and carrier occurs transversely to the plane of the drawing of FIG. 1. The reciprocative path 1*a* (FIG. 2) of the carrier may amount to, from end-to-end position, about 6.5 mm or ¼ of an inch so that at least one character in the matrix pattern mode will be covered in its entire widths.

The electromagnets 4 on the carrier 1 are constructed as solenoid magnets so that the print elements 2 are always maintained in a retracted position. Upon actuation, i.e. energization of the respective electromagnets the print elements are so to speak shot into the print position. As far as these print elements are concerned, print needles or style are shown here by way of example only. Instead one could use so called printer hammers in which the print element proper is a point at the end of a strip. These strips are usually resilient and may operate in accordance with the principle of stored mechanical energy. A permanent magnet is provided to hold these print hammers back and energization of the respective electromagnet causes cancellation of the magnetic field so that by resilient action the print hammer is propelled forward into the print position. This is mentioned here only by way of example to demonstrate that, in fact, the inventive principle can be employed either for styli or for print hammers, using in that regard conventional configurations.

The electromagnets 4 are connected to the cable connectors 3 and through them to an electronic circuit not shown in detail but provided for the selective actuation of the respective electromagnets in dependence upon the selective call up from a character generator. This aspect is known and not part of the invention. The matrix printer is therefore provided for connection to a suitable interface structure for example for purposes of interfacing with a data processing system or device.

The carrier 1 is to move in a reciprocating fashion and is constructed from a lightweight material such as an aluminum alloy. In its basic configuration this carrier 1 can be understood to be a L-shaped rod or bar 5. The bar 5 may be made as a casting piece using another light alloy or even made of a suitably durable synthetic. The print medium 7 is partially looped around the platen 6. Also interposed is a color or ink ribbon 7*a* shown in FIG. 2.

From an overall point of view the rod or bar 5 is, as far as its L-shaped configuration is concerned, constructed so that the horizontal portion faces away from the platen. Generally speaking it establishes an open interior 8 which is open towards the rear and in up direction. Sidewalls 8a and 8b bound the ends of this rod 5 and complete structurally carrier 1. Basically the rod 5 or bar 5 is comprised of a sidewall 9 being essentially upright, except for a top curvature, and of a horizontal bottom part 10. The electromagnets 4 are mounted to the sidewall 9. The wall 9 is provided with a longitudinally running rib 11 being essentially the element for accommodating and receiving bores 12 whose function is to mount the magnets 4 and the print needles but whose position and relative location is decisive for spacing and orienting the magnets as well as the needles in relation to each other. The magnets 4 are respectively provided with a guide shaft 13 which is threaded and is respectively received in the bore 12. A fastener 14 being constructed in this instance as a threaded annulus is inserted into the rib 11. This fastener is accessible and mounted from the side of the carrier 1 and wall facing the platen 6.

The wall 9 as stated is slightly curved or one can say it is slightly inclined at the top primarily to permit free inspection of the print gap as it is established between the tips of the print elements and the platen as well as the material being printed on. A plurality of guide projections 15*a*, 15*b*, and 15*c*, extend from the shuttle on carrier 1 being commensurate in width with the displacement path 1*a* of the carrier during reciprocating motion. These projections 15*a*, 15*b*, and 15*c*, bear against stationary rollers 17 journaled for rotation on the chassis or frame 16, and holding the carrier 10 in an upright position as illustrated. The guide projections 15*a*, 15*b*, and 15*c*, are comprised of strong i.e. hardened section elements, and they are constructed and the material is selected to offer a playfree and low in wear guide surfaces to the rollers 17. The rollers may be smooth or provided with a surface profile. The rolls 17 are mounted on eccentric supports 17*a*. This eccentricity permits that their relative (lateral) disposition in the horizontal, towards or away from the projections 15*a* or *b* or *c* can be individually adjusted during and after assembly particularly after some unavoidable wear has taken place.

The electromagnets 4 are provided with cable connections 3 extending into the interior space 8 of the bar. It may be assumed for example that there are altogether thirty three (33) print elements and electromagnets so that sixty six (66) cable connections are required for providing electric current to all of the electromagnets on the carrier 1. These connections have to be run out of the space 8 and in some fashion towards stationary contacts which in turn lead to the electronic circuit and control for the electromagnet energization and actuation. For this then each of the magnets 4 is provided with two (2) very thin and very flat conductors 18 and 19. These conductors are immediately soldered to the output terminals or contacts as they extend from the respective electromagnetic coils.

The conductor strips 18 and 19 run up along the inner surface of the wall 9 and are fastened thereto by means of a first holding structure 24 shown in particular in FIG. 3. The flat conductors 18 and 19 run from that fastening point in parallel paths and in juxtaposed relationship and they form a curve, or bow 21, down again and horizontally off, leading to a contact sleeve 18*a* which in turn pertains to the electronic circuit that drives the magnets 4.

Figure 5:
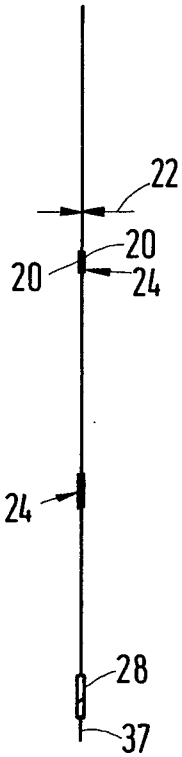
FIG. 5 is a side view or a view taken along lines V—V in relation to and of the flat ribbon cable as shown in FIG. 4.

As shown particularly in FIG. 5 the conductors 18 and 19 are flat and enveloped in a transparent electrically insulating carrier material having a minimum thickness of 22. They are run in pairs 23 to the holding and fastening structure 24 which is also shown in FIG. 1 and particularly shown in FIGS. 3 and 4. The individual flat electrically insulated conductor pieces 18 and 19 are fastened above or below of the electromagnetic coils 4 by means of the holding strip 20 constituting the fastener 24. This particular strip is comprised of a simple electrically insulating adhesive strip material.

From fastener 24 the conductors run individually or in groups to another holding structure 25 on a bracket 16*a* and of a cable holder 18*a*. At some point the conductors are combined so as to constitute and establish a single ribbon cable 26. The ribbon cable 26 then includes transition 29 wherein the curved portion 21 veers into a particular direction and here the holders 24 are provided on both side of the ribbon cable as shown particularly in FIG. 5.

The ribbon cable 26 can be divided into groups 27 of conductors whereby each group ends in one particular plug element such as 28; there are shown three (3) such plug elements, the number itself is basically arbitrary but convenient in this particular environment.

The plugs 28 are run into the respective sleeves or sockets 18*a* of the stationary electronic circuit. The conductor arrangement as described is capable as per FIG. 2 to undergo the reciprocating motion i.e. to follow the reciprocating motion of the carrier to the left and to the right with a maximum deflection by about a ¼ of an inch from end-to-end and it was found that even on the long term use no damage occurs.

Figure 4:
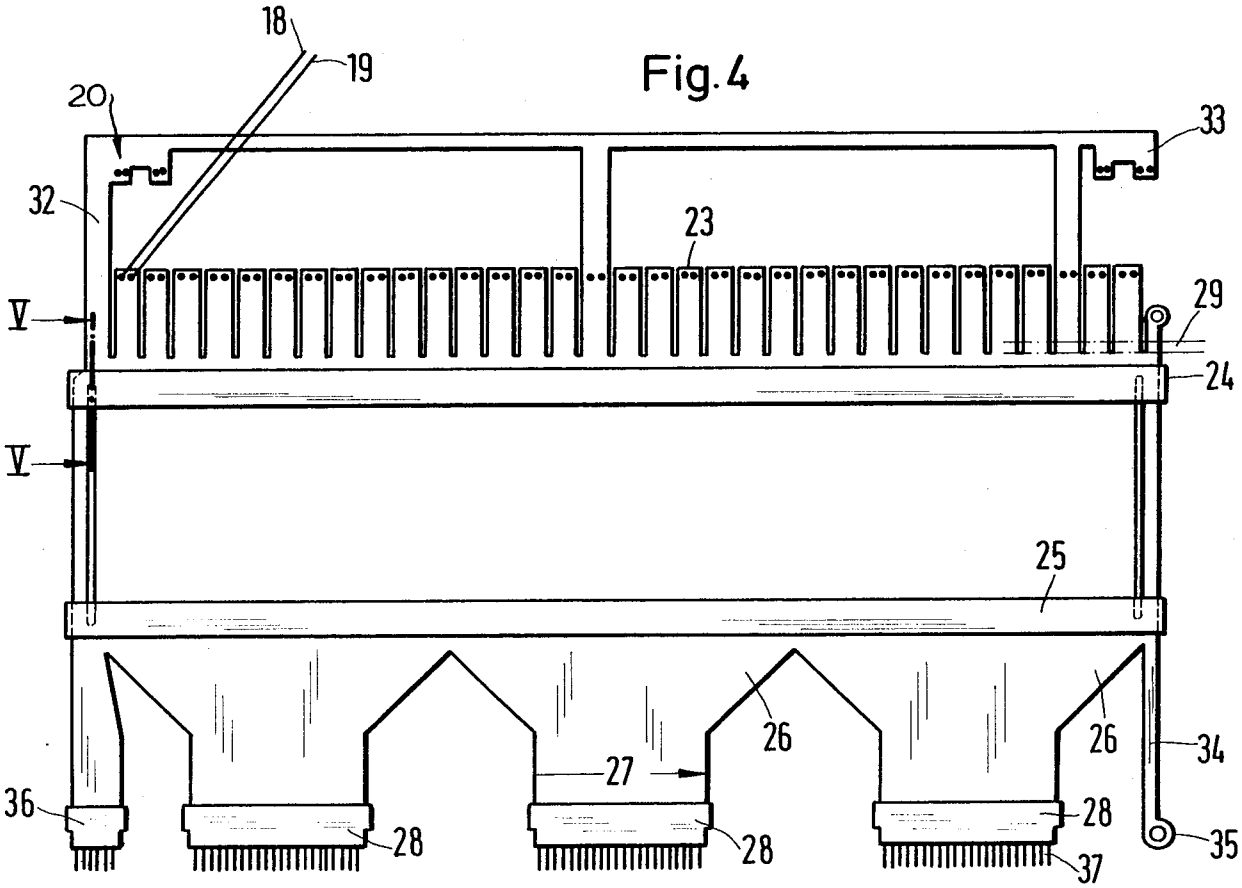
FIG. 4 is a top elevation of a flat ribbon cable used in conjunction with the equipment shown in FIGS. 1, 2 and 3.

The arrangement of the conductors as shown in FIG. 4 and 5 is particularly suited to accomodate additional electrical equipment and additional conductors which can be run into and become part of that particular cable. These additional pieces of equipment are generally denoted by reference numeral 31 and may include sensors such as position sensors of the carrier or the like. For this additional flat conductor 32, 33, and 34 are provided for. The connection to ground, mass or earth 35 is then run to the chassis or frame 16. The conductors 32 are accommodated by a particular plug 36. Single piece manufacture is possible for such a conductor and its guide and positioning system permitting particularly that the conductor is electrically insulated from all sides. Only the ends at the conductors 18 and 19 as well as on the pins 37 insulation has been removed.

The invention is not limited to the embodiments described above, but all changes and modifications thereof, not constituting departures from the spirit and scope of the invention, are intended to be included.

We claim:

1. In a matrix line printer having a printing platen, a plurality of electromagnetic actuators and a plurality of print elements actuated by the actuators, all being mounted in chains the improvement comprising:

a reciprocating carrier and shuttle element of elongated construction and essentially L-shaped cross-section having an upright wall and an essentially horizontal bottom wall integral therewith, the carrier element positioned so that the upright wall faces the platen;

a plurality of projections extending from said carrier in a rearward direction away from said platen; there being guide rollers journaled in the chassis of the printer engaging the projections for holding the carrier in an upright position;

a plurality of bores accurately spaced and arranged along a line in said upright wall;

a plurality of fastening means arranged in said bores and being accessible from the side of the upright wall facing the platen;

the electromagnet actuators and print elements being secured to said fastening means and located in a space as defined between said bottom wall and said upright wall, the print elements projecting through the upright wall and in a direction toward the platen that is opposite a direction of extension of the bottom wall of the L-shaped carrier; and means for reciprocating said L-shaped carrier in a direction of the line as established by said bores.

2. The improvement as in claim 1 wherein each of said rollers is individually adjustable.

3. The improvement as in claim 2 said adjustment being provided by eccentric mounting of said rollers.

4. The improvement as in claim 1 wherein each of said electromagnet i.e. actuators is connected electrically to two flat, electrically conductive, but insulated elements running in an arch or curve from a magnet of one of the actuators as mounted on the carrier to stationary fastening and connecting means.

5. The improvement as in claim 4 wherein all of said conductive and insulated elements are physically fastened in common by fastening means to said upright wall which is remaining insulated from each other and wherein additional stationary fastening means are provided in a portion of transition as each of the conductive and insulative elements veers from the curve to a straight extension.

6. The improvement as in claim 5 wherein downstream from said fastening means all of said flat conductors are combined in a ribbon cable, groups of insulated conductors in said ribbon cable leading to a common plug.

7. The improvement as in claim 5 said fastening means being an adhesive ribbon.

8. An improvement as in claim 5 wherein said additional fastening means is provided for holding the transition between the curved portion of any of the conductive and insulated elements and a respective portion that runs into the ribbon cable from both sides, the fastening means being flexible.

9. The improvement as in claim 6 there being additional circuit elements with conductors being included in said ribbon cable.

* * * * *